United States Patent [19]

Salaz

[11] Patent Number: 4,804,180

[45] Date of Patent: Feb. 14, 1989

[54] KTB EXERCISER

[76] Inventor: Ruben D. Salaz, P.O. Box 10515, Alameda, N. Mex. 87184-0515

[21] Appl. No.: 64,656

[22] Filed: Jun. 22, 1987

[51] Int. Cl.[4] ..... A63B 21/04

[52] U.S. Cl. ..... 272/136; 272/96

[58] Field of Search ..... 272/135-138, 272/142, 70, 96, 97, 134, 901; 128/25 R, 25 B

[56] References Cited

U.S. PATENT DOCUMENTS

| | | | |
|---|---|---|---|
| 3,421,760 | 1/1969 | Freeman, Jr. | 272/142 |
| 3,628,791 | 12/1971 | Garcia | 272/70 |
| 3,633,907 | 1/1972 | Cane | 272/901 |
| 3,754,547 | 8/1973 | Walker | 272/135 |
| 3,874,656 | 4/1975 | Winterstellar | 272/142 |
| 4,149,715 | 4/1979 | Kusmer | 272/96 |
| 4,645,197 | 2/1987 | McFee | 272/142 |
| 4,645,200 | 2/1987 | Hix | 272/70 |

*Primary Examiner*—Richard J. Apley
*Assistant Examiner*—J. Welsh

[57] ABSTRACT

A therapeutic, portable exercise apparatus which strengthens the knees, quadriceps, hamstrings, and buttocks. The base comprises a parallel front and rear connected by a transverse member at their midpoints. Handle bars are mounted at the front by a telescoping support. On the transverse member there are two rigidly mounted anchors. The anchor closest to the front holds a length of angle iron containing a configuration of at least five holes. The second anchor mounted toward the rear of the base holds a pedal arm pivotally mounted at one end and a rigid foot pedal at the other end. In the middle of the pedal arm is rigidly mounted a duplicate configuration of five holes. An extension spring is connected from a hole in configuration to configuration, thus raising the pedal arm off the base. The user steps on the rear of the base, grasps the handle bars for balance as s/he places one foot on the foot pedal and pushes it down to the base then allows it back up and repeats the cycle as desired.

1 Claim, 2 Drawing Sheets

KTB EXERCISER

BACKGROUND OF THE INVENTION

1. Technical Field

The instant invention relates to portable therapeutic body exercising apparatus, specifically to devices for rehabilitating the knee that has suffered the trauma and/or debilitation of injury and/or surgery. The KTB Exerciser is also related to portable leg exercisers that strengthen the thigh and buttock muscles.

2. Description of the Prior Art

Physicians generally agree that strengthening of muscles and tendons related to the knee substantially aids in the rehabilitation and/or prevention of various types of knee injuries. While knee injuries are perhaps the most common injuries in athletic competition at all levels there have been a dearth of affordable exercise apparatus designed primarily for knee rehabilitation. One of the most popular machines used by many hospitals and sports therapy centers is the "Cybex" but it is expensive in the extreme for private ownership. The bicycle is universally accepted as beneficial to health and its use is an aid in promoting knee rehabilitation in most therapy gynmasiums. Ankle weights are also beneficial. There are many other exercise apparatus which have a direct or indirect bearing on knee rehabilitation (rowing machine, rope skipping, leg press, etc.) but few if any of these were created with injured or surgically corrected knees in mind. Accordingly, it is one of the objects of the instant invention to provide a low cost therapy exerciser that will improve the integrity of the knee joint.

SUMMARY OF THE INVENTION

It is a principal object of the present invention to provide a low cost exercise device for the individual who desires to strengthen knees, thighs, and buttocks in a home environment or in a hospital or gymnasium. In accordance with the invention, the KTB Exerciser comprises a base having a parallel front and rear connected at their midpoints by a transverse member. Handle bars are telescoped into a metal tube at the front. Two anchors are rigidly mounted on the transverse member, one toward the front, the other toward the rear. From the rearward anchor is pivotally connected a pedal arm which ends in a rigid foot pedal. Rigidly mounted to the forward anchor is a length of angle iron which contains a configuration of five or more holes, an exact duplicate of which is rigidly mounted on the pedal arm. The two lengths of angle iron are mounted "facing" each other. An expansion spring with hook portions adjacent both ends connects the two configurations, thus raising the pedal off the base. The user steps on the foot of the base, grasps the handle bars to maintain balance, puts one foot on the foot pedal then forces it down smoothly then allows it back up in the same manner. The cycle is repeated as many repetitions as desired.

Said spring provides a yieldable force resistance that doesn't strain the knee as does dead weight like metal plates. The exercise provided the user of the KTB is isotonic (constant resistance, variable speed) in nature, concentric (shortening muscle contractions on the downward press of the foot) as well as ecentric (lengthening muscle contractions on the upward movement of the foot).

An important aspect of said exercise on the KTB is that it's performed while the user is weight bearing.

The KTB Exerciser is simple in design in order to promote low cost. Yet, because it utilizes basic principles of leverage the same spring offers differing resistances merely by mounting said spring to multiple, selectable positions in the aforementioned configurations.

It is therefore a principal object of the present invention to provide a low cost, therapeutic, portable exercise device to strengthen knees, thighs, and buttocks in a home environment or in a hospital or gymnasium.

Another object of the invention is to provide an exercise device whose means of resistance is adjustable to various tensions or degrees of resistance so as to be adaptable for use by persons of varying strengths. As the user becomes stronger s/he will be able to increase resistance as desired, merely by mounting the same spring to a different position.

A further object of the invention is to provide an exercise device which may be used without the assistance of a professional therapist.

A further object of the invention is to provide an exercise device in which the user is weight bearing rather than sitting or lying down.

With these and other objects in view the KTB Exerciser will be best understood from a consideration of the following detailed description taken in connection with the accompanying drawings forming a part of this specification. It is to be understood that said KTB Exerciser is not confined to any strict conformity with the showing of the drawings but may be modified or changed so long as such changes or modifications make no material departure from the salient features of said KTB as expressed in the appended claims.

DESCRIPTION OF THE PREFERRED EMBODIMENT

Figure 1:
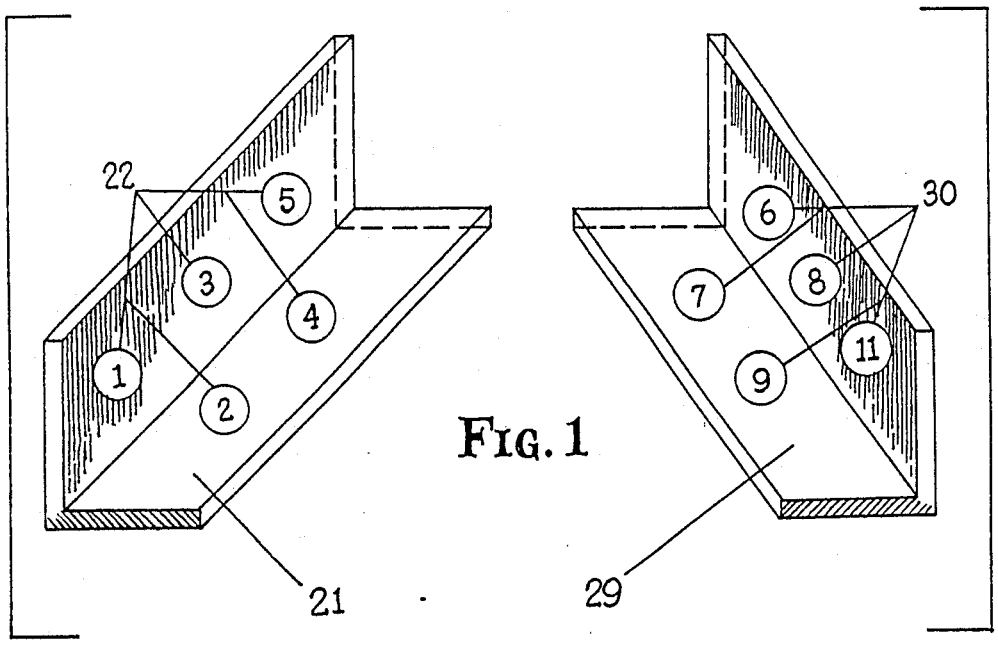
FIG. 1 is a pictorial view of the angle iron with the configuration of holes which enable the user to mount the extension spring at multiple, easily selectable positions.
Figure 2:
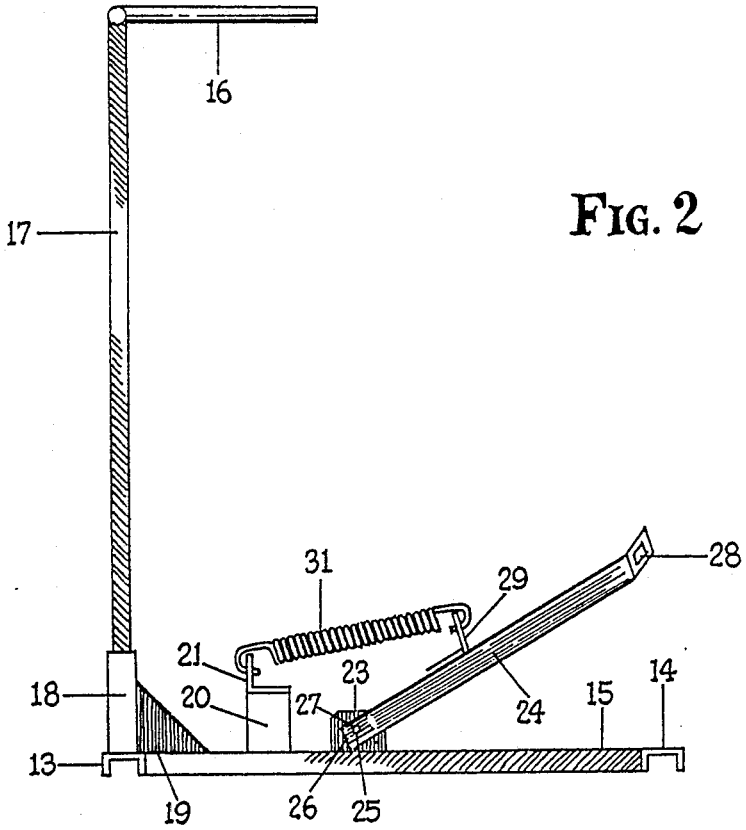
FIG. 2 is a right side view of the preferred embodiment of the present invention.
Figure 3:
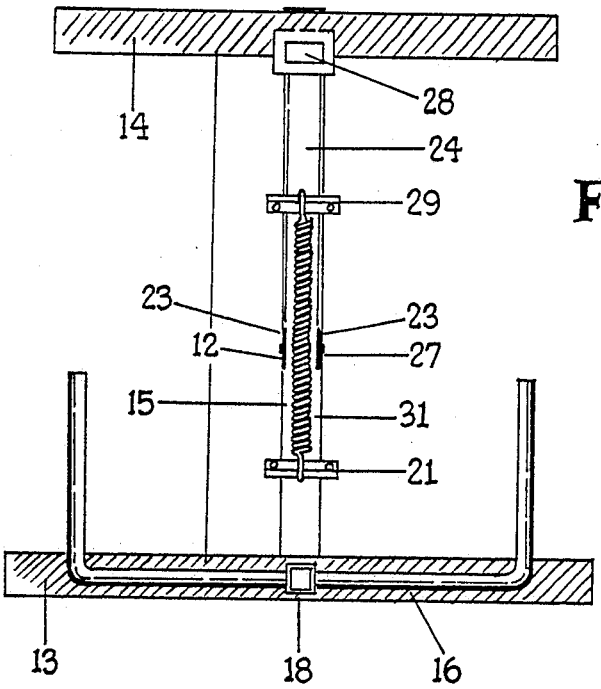
FIG. 3 is a top view of the present invention.
Figure 4:
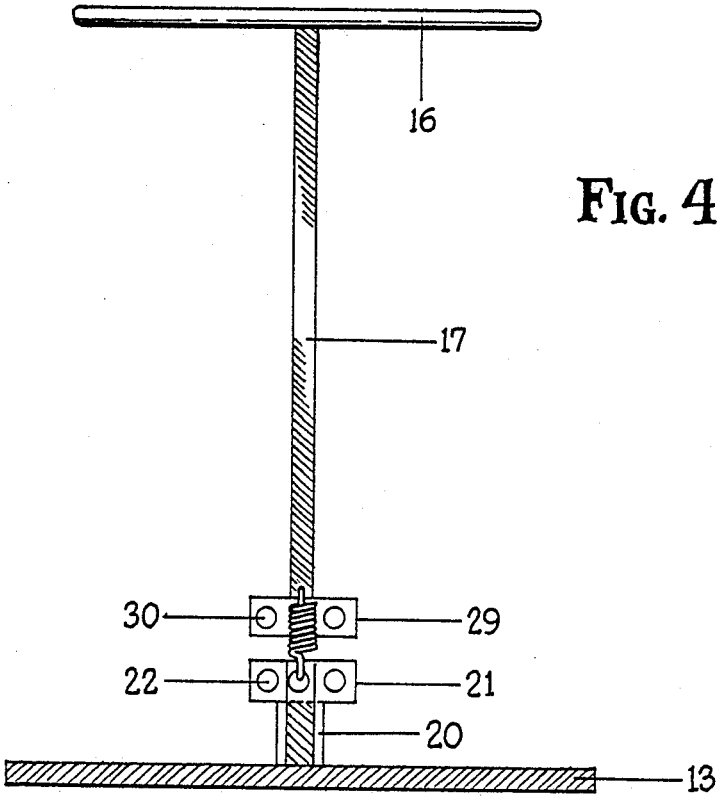
FIG. 4 is a front view of the present invention.

Referring now to the drawings, which are not done to scale, the preferred embodiment of the exerciser constructed in accordance with the present invention is indicated generally by the reference numeral 10. Like parts in the different figures are referred to by the same reference numerals. My KTB Exerciser 10 comprises a base 12 having a parallel front 13 and rear 14 connected at their midpoints by a transverse member 15, thus forming an approximate "H" shaped base 12 which is rigidly welded together and made of channel iron. A curved handle bar 16 is rigidly mounted to a support 17 which telescopes into a metal tube 18 which is rigidly mounted at the midpoint of the front 13 of the base 12. Said tube 18 employs a gusset 19 as reinforcement toward the transverse member 15 direction. Rigidly mounted on the transverse member 15 proximate to the front 13 of said base 12 is an anchor 20. On said anchor 20 is rigidly mounted a length of angle iron 21 which contains a configuration 22 of at least five holes. Proximate toward the rear 14 of said transverse member 15 is a second anchor 23 to which is pivotally mounted a pedal arm 24.

Said pedal arm 24 has a hole 25 drilled into it at the pivotally anchored end 26, thus enabling a nut and bolt 27 to fasten said pedal arm 24 to the second anchor 23 on the transverse member 15 of the base 12. At the other extremity of said pedal arm 24 is rigidly mounted a foot pedal 28. Proximate to the middle of said pedal arm 24 is rigidly mounted a duplicate length 29 of angle iron which contains a duplicate configuration 30 of at least five holes. An extension spring 31 is connected from a hole in one configuration 22 to a hole in the duplicate configuration 30, thus raising the pedal arm 24 to the desired height and resistance. The user steps on the rear 14 of the base 12, grasps the handle bars 16 to maintain balance then places one foot on the foot pedal 28 and presses downward with the foot then allows said foot pedal 28 upward in a smooth fashion. The cycle is then repeated as desired by the user.

The spring 31 supplied with each KTB Exerciser 10 provides variable resistance because it can be connected at selectable, multiple position holes in the configurations 22, 30. Said position holes selected can raise or lower the height of the foot pedal 28 and they also engage the full or partial strength of the spring 31. In brief, the least resistance of the spring 31 is derived by connecting hole 4 to hole 7 (that is, bottom holes of 21 to bottom holes of 29); more resistance is achieved by connecting hole 4 to hole 6 (bottom holes of 21 to top holes of 29); and the greatest resistance is created by connecting hole 3 to hole 8 (top holes of 21 to top holes of 29). More than one spring 31 can be utilized if greater resistance is desired.

What I claim as new and desire to secure by Letters Patent of the United States is:

1. A portable therapeutic exercise device for exercising the knees, thighs, and buttocks of a user comprising:

(a) a base having a parallel front and rear connected at their midpoints by a transverse member;

(b) a handle bar mounted at the front of said base by a telescoping support;

(c) a pedal arm pivotally mounted to said base at one end and including a foot pedal at its other end so that said pedal is approximate the rear of the base;

(d) a first length of angle iron with at least five holes mounted on said pedal arm;

(e) a second length of angle iron with at least five holes mounted on said base at a position closer to the front of said base than said pivotal mount of said pedal arm; and (f) a spring connected between one of said holes in said first length to one of said holes in said second length wherein the spring may be connected between a varying pattern of holes in order to vary the resistance of the device.

* * * * *